United States Patent [19]

Ortemond

[11] Patent Number: 4,844,660

[45] Date of Patent: Jul. 4, 1989

[54] APPARATUS AND METHOD FOR REMOVING OFFSHORE PILINGS

[76] Inventor: Leon D. Ortemond, Rte. 2, Box 2290, Abbeville, La. 70510

[21] Appl. No.: 122,586

[22] Filed: Nov. 17, 1987

Related U.S. Application Data

[63] Continuation of Ser. No. 929,541, Nov. 10, 1986, abandoned.

[51] Int. Cl.[4] ..... E02D 9/04; E21B 29/12; B23D 21/14

[52] U.S. Cl. ..... 405/224; 405/195; 405/203; 166/55.7; 30/103; 83/184

[58] Field of Search ..... 405/195, 216, 224–228, 405/232; 166/55.7, 55.8, 298, 361; 30/103–108; 82/4 C, 82, 1.2; 175/32 S; 384/193, 226, 227

[56] References Cited

U.S. PATENT DOCUMENTS

| | | | |
|---|---|---|---|
| 194,149 | 8/1877 | Harris | 166/55.7 |
| 1,782,069 | 9/1929 | Meijer | 166/55.7 |
| 3,331,439 | 7/1967 | Sanford | 166/55.8 |
| 3,378,072 | 4/1968 | Smith | 166/55.8 X |
| 3,396,795 | 8/1968 | Venghiattis | 166/55.7 |
| 3,859,877 | 1/1975 | Sherer et al. | 82/82 |
| 4,389,765 | 6/1983 | Thompson | 166/55.8 X |
| 4,576,070 | 3/1986 | Fitzgerald | 82/82 |
| 4,585,374 | 4/1986 | Regalbuto et al. | 405/227 |

FOREIGN PATENT DOCUMENTS

| | | | |
|---|---|---|---|
| 60487 | 5/1977 | Japan | 30/105 |
| 66231 | 4/1982 | Japan | 30/103 |

*Primary Examiner*—Randolph A. Reese
*Assistant Examiner*—John A. Ricci
*Attorney, Agent, or Firm*—Browning, Bushman, Zamecki & Anderson

[57] ABSTRACT

An assembly for severing tubular piling used to support offshore platforms comprising a support or frame secured adjacent the open, upper end of the piling, a cutting string suspended from the support and comprised of a pipe string, a centralizer and an internal pipe cutter and a power swivel to rotate the cutting string to effect internal severing of the piling.

7 Claims, 5 Drawing Sheets

FIG. 4
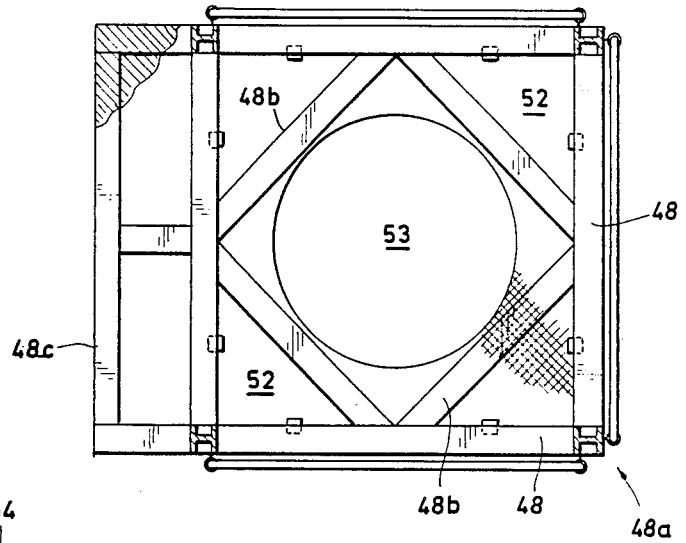
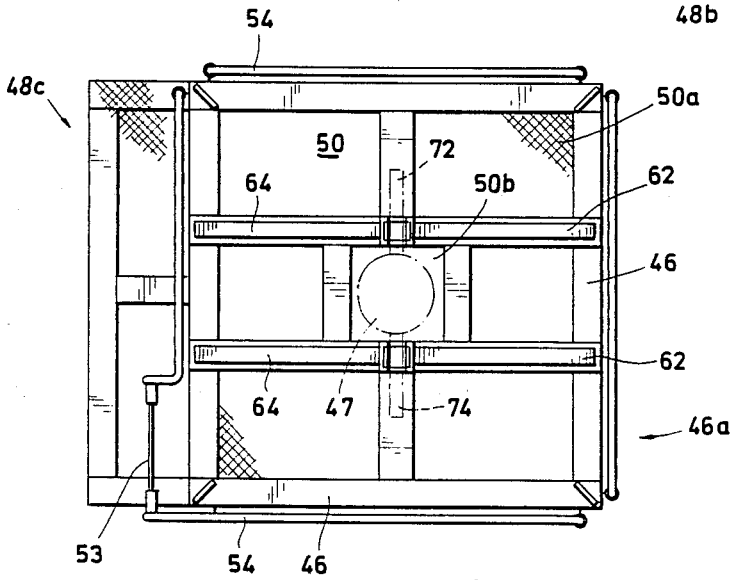
FIG. 5
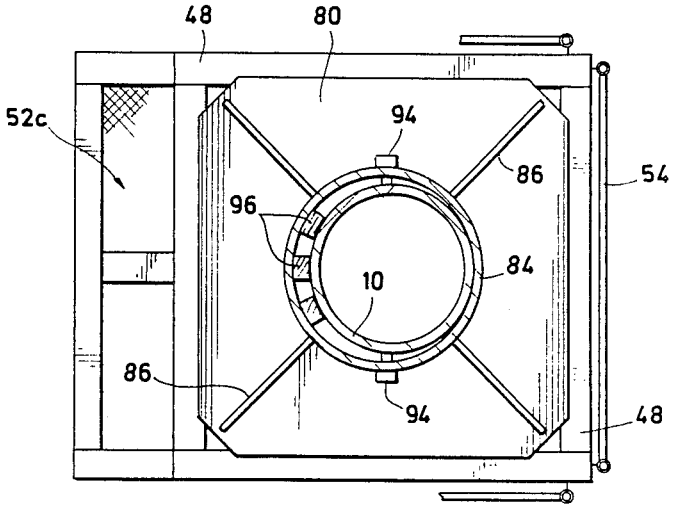
FIG. 6

FIG. 7
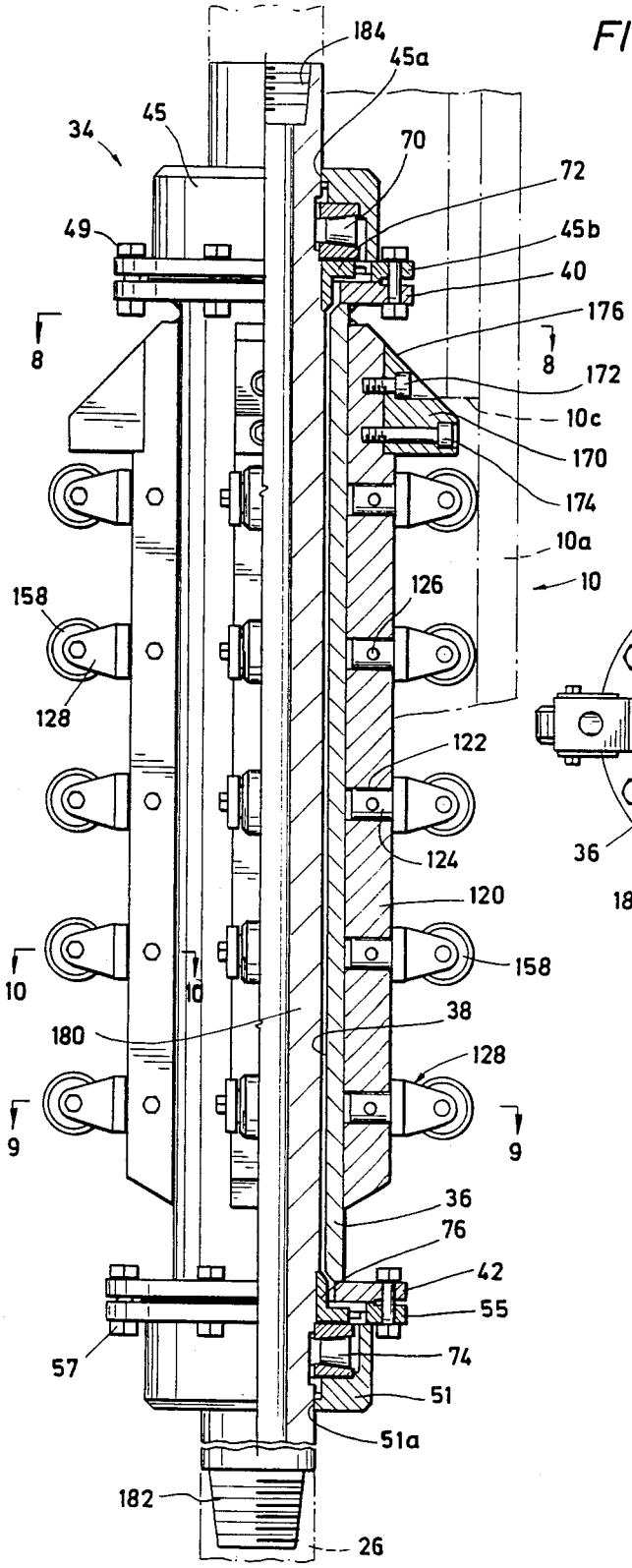
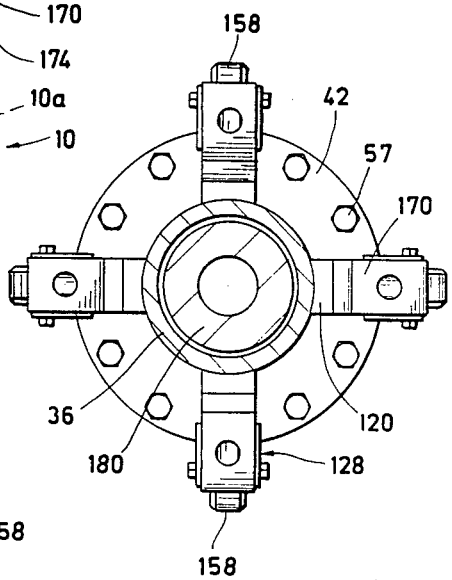
FIG. 8

APPARATUS AND METHOD FOR REMOVING OFFSHORE PILINGS

This is a continuation of co-pending application Ser. No. 929,541 filed on Nov. 10, 1986, now abandoned.

BACKGROUND OF THE INVENTION

1. Field of the Invention

The present invention relates to the removal of offshore platforms and, more particularly, to the severing and removal of tubular pilings or pipe which support such platforms.

2. Description of the Prior Art

Offshore platforms which are used for the production of oil and gas from deposits below the ocean floor are commonly constructed by driving a section of tubular piling or pipe into the ocean bed a considerable distance followed by welding successive lengths of piling until the desired height is achieved, the piling serving as legs for the platform. Once the piling has been set, a framework is then attached to the legs and decking added to support the production equipment, housing facilities and the like. The offshore production platform is generally considered a permanent structure in the sense that it is erected at a single location and remains there as long as there is oil and/or gas production. However, once the oil and gas production plays out, the production platform must be removed since it may pose a hazard to shipping. Since many offshore oil and gas production areas are now reaching maturity, there are an increasing number of production platforms which must be removed.

The removal of an offshore platform presents several difficulties, not the least of which is the fact that the platform is erected in an environment which at times is harsh. Complicating the matter is the fact that it is generally required that the legs of the platform, i.e. the piling, be severed at a point far below, e.g. 15–20 feet, the ocean floor. One technique which has been used for severing the piling involves the use of explosives which are used to sever the piling at the desired point below the ocean floor. However, grave environmental damage can result from the use of this technique as it may result in the death of fish, sea turtles, porpoises, etc. Moreover, the use of subsea explosives in removing offshore piling can result in churning up mud, silt and sand from the ocean floor which can irrevocably damage sensitive coral reefs and the like. Lastly, the use of explosive techniques to remove the piling usually requires the use of deepsea divers with all the attendant hazards.

SUMMARY OF THE INVENTION

It is therefore an object of the present invention to provide an assembly for severing offshore tubular piling.

Another object of the present invention is to provide a non-explosive method for severing offshore tubular piling.

The above and other objects of the present invention will become apparent from the drawings, the description given herein and the appended claims.

The severing assembly of the present invention comprises a support means or frame which is secured to the upper, open end of the piling, usually at a point above the water level. A rotatable pipe string is suspended from the support means and extends down into the tubular piling. A centralizer or stabilizer is secured in the pipe string to maintain the pipe string generally coaxial with respect to the tubular piling, the pipe string being rotatable with respect to the centralizer body such that the centralizer body remains substantially stationary as to rotation as the pipe string rotates. A cutter apparatus is secured to the lower end of the pipe string and generally in relatively close proximity to the centralizer, the cutter apparatus includng means such as cutter blades for severing the tubular piling in response to rotational movement of the pipe string. There is also provided a means to rotate the pipe string such as a portable power swivel positioned on the support means.

In the method of the present invention, a support means or frame is secured on an offshore tubular piling adjacent the upper, open end. A cutting string is suspended from the support means and extended into the tubular piling. The cutting string includes a pipe string, a centralizer means and a cutter apparatus, the centralizer means and cutter apparatus being positioned internally of the tubular piling, the cutter apparatus being secured at the lower end of the pipe string, the cutter apparatus including a means for severing the tubular piling in response to rotational movement of the pipe string. The pipe string is then rotated to permit the cutter apparatus to sever the tubular piling after which the severed piling is pulled from the ocean floor.

BRIEF DESCRIPTION OF THE DRAWINGS

FIG. 4 is a view taken along the line 4—4 of FIG. 3.

FIG. 5 is a view taken along the line 5—5 of FIG. 3.

FIG. 6 is a view taken along the line 6—6 of FIG. 3.

FIG. 7 is an elevational view, partly in section, showing the centralizer of the severing assembly of the present invention.

FIG. 8 is a view taken along the line 8—8 of FIG. 7.

DESCRIPTION OF THE PREFERRED EMBODIMENT

While the present invention will be described with particular reference to severing of tubular piling and the like which support offshore platforms for the production of oil and gas, it is to be understood that the invention is not so limited. The apparatus and method of the present invention can be used for the internal severing of any tubular member which has a portion buried or otherwise readily inaccessible, e.g. below ground level, below ocean floor, etc. Thus, the apparatus and method can be used whenever it is desired to sever a tubular member at a point wherein the external portion of the tubular member is generally not accessible without excavation or the like. The term "piling" as used herein refers generally to cylindrical, elongate members which are tubular in nature.

Figure 1:
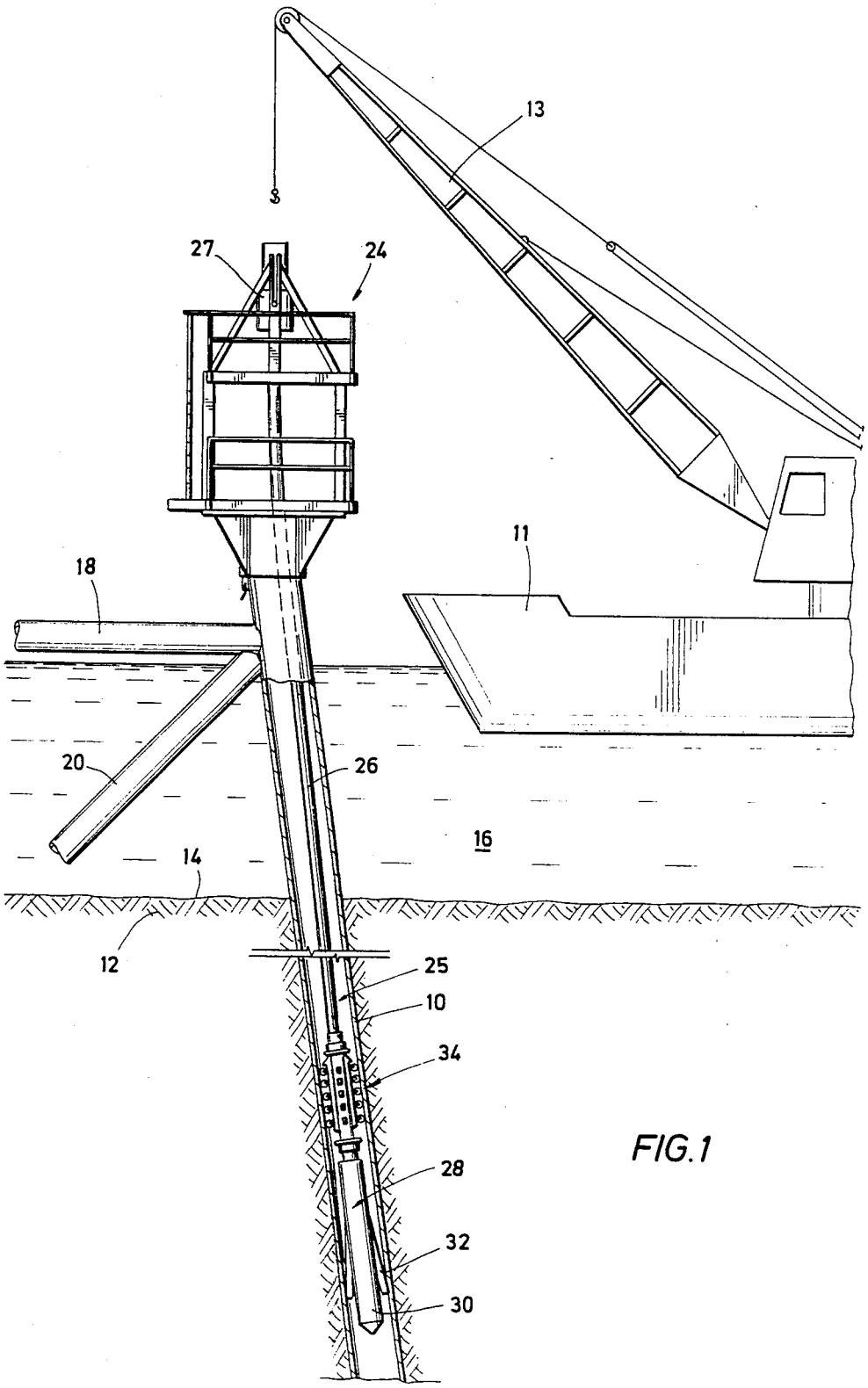
FIG. 1 is an elevational view, partly in section, showing a tapered tubular piling, the severing assembly of the present invention and a derrick barge for erecting the severing assembly on the piling.

Referring first to FIG. 1, there is shown a portion of an offshore production rig comprising a leg or tubular piling 10 which has a portion buried in the earth 12 below the floor 14 of the ocean 16. Positioned adjacent piling 10 is a derrick barge 11 having a crane 13. Although not necessary, the derrick barge 11 provides a convenient method to erect the severing assembly on the piling 10 and, once piling 10 has been severed, to remove both the assembly and then to pull the severed piling from the ocean floor using the crane 13. As seen, the piling 10 has a portion which extends upwardly from the floor 14 of the ocean 16 and above the surface of the ocean 16. For purposes of simplicity, only one leg 10 of the platform is shown. It will be appreciated that in a conventional offshore oil and gas production platform, there will be multiple legs or pilings supporting the platform, all of which have one end received in the earth below the ocean floor and which extend upwardly above the surface of the ocean. Extending laterally from the leg or piling 10 are structural braces or structural members 18 and 20. It will be appreciated that in a conventional offshore platform, structural members or braces 18 and 20 provide a framework upon which rests one or more decks or subdecks on which are placed the production equipment, living quarters for the crew, helicopter pads, etc.

In the structure shown in FIG. 1, the upper portion of the platform, including the decks and most of the supporting framework, have already been removed leaving only the leg 10 with braces 18 and 20 to be removed. To this end, the leg 10 is severed, e.g. by cutting with a cutting torch or the like, at a point above the level of the ocean 16. To this upper, open end 22 (FIG. 2) of leg 10, a support or frame, shown generally as 24, is secured. Suspended from the support 24 is a cutting string shown generally as 25 which comprises a pipe string 26, a centralizer 34 and a cutter apparatus 28. Pipe string 26 can take the form of sections or ordinary drill pipe and, accordingly, can be made up sequentially to any desired length. The pipe string 26 extends downwardly into leg 10 the desired distance. Received on the end of pipe string 26 and rotatable therewith is the cutter apparatus 28 of a type conventionally used to sever well casing. Cutters of this type are well known and described, for example, in U.S. Pat. No. 2,322,694, No. 3,378,072, No. 3,331,439 and No. 4,068,711. Basically, such cutters comprise a tubular body 30 having blades or cutting arms 32 which are selectively expandable and retractable laterally outwardly from the body 30 in response to a mechanism (not shown) within body 30 and which internally sever the pipe when the body 30 is rotated. The centralizer 34, described more fully below, is secured in the cutting string 25 above and closely adjacent the cutter apparatus 28. Centralizer 34 ensures that the cutting string 25 remains generally coaxially aligned within leg or piling 10.

Supported by the support or frame 24 is a power swivel 27, power swivel 27 being used to rotate cutting string 26. Although not shown, power swivel 27 is connected to a suitable power supply carried by derrick barge 11. Alternately, power to the swivel 27 can be supplied from equipment on a temporary deck on the offshore platform or on a deck or subdeck which has not been removed from the platform.

In the method, once the frame 24 is first secured to the piling 10 and the pipe string 26 together with the centralizer 34 and cutter apparatus 28 lowered into the piling 10, the cutter apparatus being positioned at the desired point in piling 10. As previously noted, it is generally required that the piling be severed at a point substantially below the ocean floor such as, for example, 10 to 20 feet. The power swivel 27 is then started and rotation of cutting string 25 commenced. As the cutter apparatus 28 rotates, cutter blades 32 are urged laterally outwardly from body 30 against the inner wall of casing 10. As the rotation of cutting string 25 continues, blades 32 eventually cut through the wall of the piling 10. Once piling 10 has been severed, frame 24 and cutting string 25, comprised of pipe string 26, cutter apparatus 28 and centralizer 34 are removed from the piling 10, after which the crane 13 can be used to pull the severed section of piling 10 from the ocean floor.

Referrig now to FIGS. 2–6, there is shown the frame or support of the severing assembly of the present invention. The support 24 includes a series of vertical members 44 secured to upper and lower horizontal members 46 and 48, members 46 being secured to one another to form a rectangular upper deck frame 46*a*, members 48 being secured together to form a rectangular lower deck frame 48*a*. As seen in FIG. 4, lower deck frame 48*a* also includes braces 48*b*. Lower deck frame 46*a* includes a web of bracing members as seen in FIG. 5. Upper and lower deck frames 46*a* and 48*a* support upper and lower decking 50 and 52 to provide upper and lower platforms for workers. Hand railings 54 are secured to the frame 24 and generally surround the upper and lower platforms. A ladder 53 extends from upper frame 46*a* to a lateral extension 48*c* of lower frame 48*a* to permit workers to move between the upper and lower platforms. Frame 46*a* provides a supporting structure for a pair of A frame assemblies, shown generally as 60. Each A frame assembly 60 comprises first and second legs 62 and 64. Leg 62 has one, lower end secured, as by welding to upper frame 46*a* while leg 64 likewise has one, lower end secured to upper frame 46*a*. Legs 62 and 64 converge and are each secured to the upper part of a vertical member 66 which in turn has its lower end secured to the webbing of upper frame 46*a*. Each of the vertical members 66 includes a slot 68 which are in register with one another as seen in FIG. 5.

Figure 2:
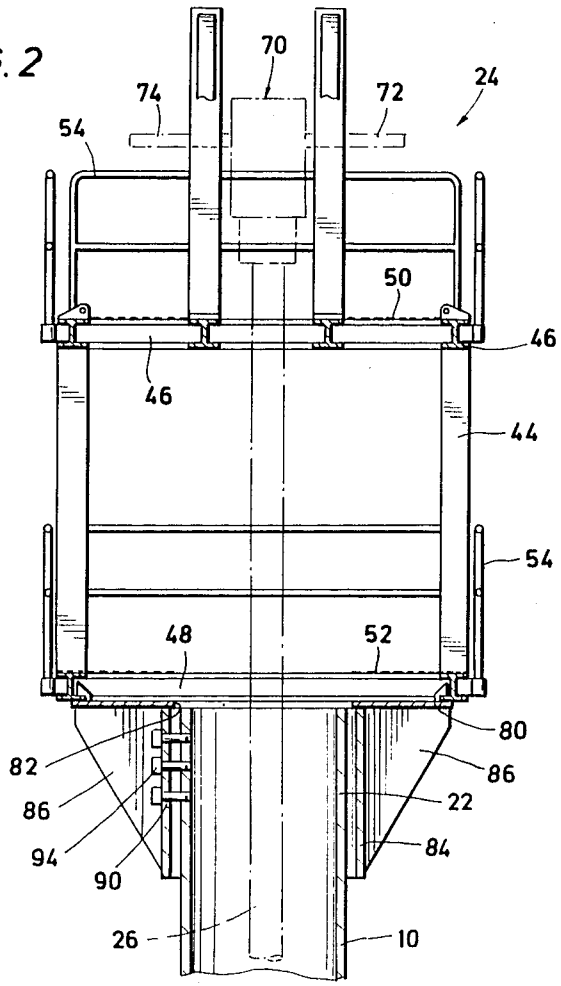
FIG. 2 is an elevational view, partly in section, showing the support means of the assembly of the present invention.
Figure 9:
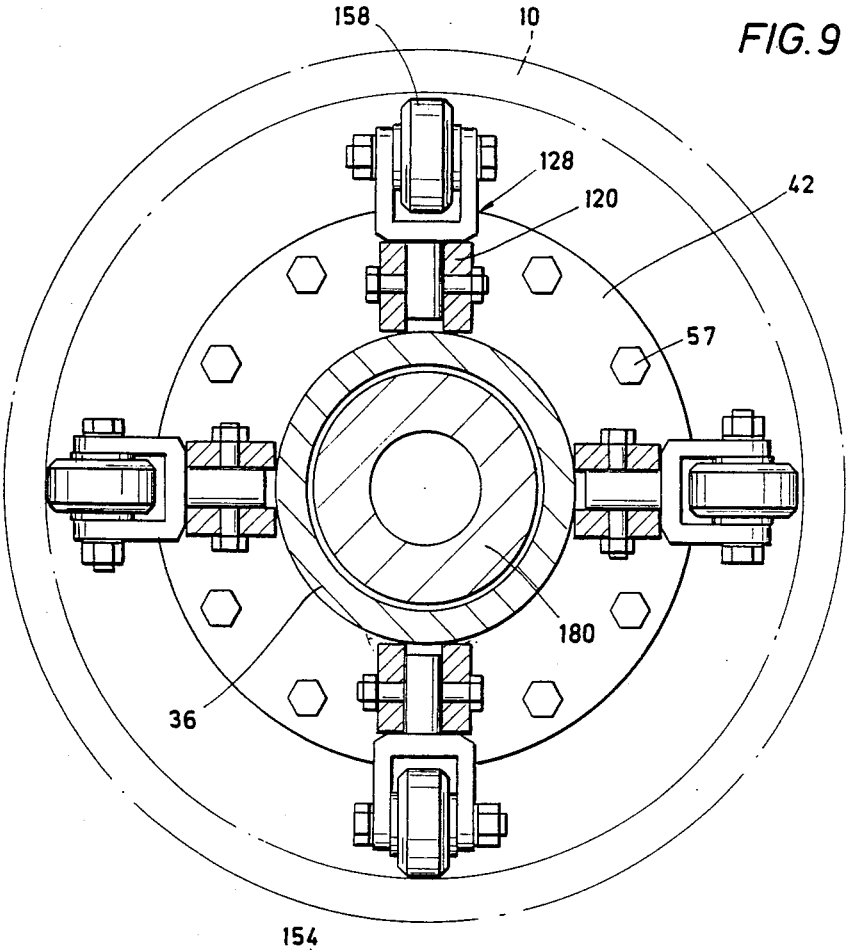
FIG. 9 is a view taken along the line 9—9 of FIG. 7.
Figure 10:
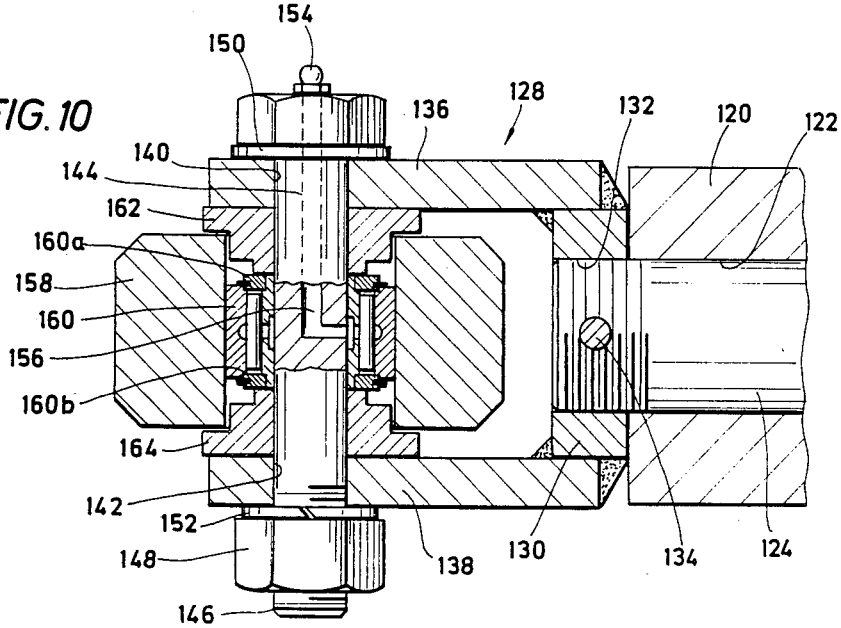
FIG. 10 is a view taken along the line 10—10 of FIG. 7.

A power swivel shown generally as 70 and having support arms 72 and 74 is supported by A frame 60, support arms 72 and 74 being received in registering slots 68 as shown in FIG. 2. Power swivel 70 is operatively secured to pipe string 26 to effect rotation thereof as described above, pipe string 26 extending through holes 47 and 53 in decking 50 and 52, respectively.

Secured to the underside of lower deck frame 48*a* is a plate 80 having a central opening 82. Thus, the pipe string 26 extends from power swivel 27 through opening 47 in decking 50, opening 53 in decking 52 and opening 82 in plate 80. A cylindrical guide tube 84 adapted to receive the upper, open end 22 of piling 10 is welded to plate 80 so as to be in register with opening 82. A plurality of gussets 86 spaced around the periphery of guide 84 are secured to plate 80 and guide 84 to provide rigid support for guide 84. Guide 84 has a plurality of holes 90 which, when the support 24 is positioned on piling 10, are in register with a series of holes 92 which have been drilled in piling 10. Received through registering holes 90 and 92 are securing bolts 94 which prevent relative rotation between support 24 and piling 10. It can thus be seen that both power swivel 27 and support 24 are restrained from rotation relative to piling 10 ensuring that as cutting string 25 is rotated, swivel 27 and support 24 will remain fixed against reactive torque.

Figure 3:
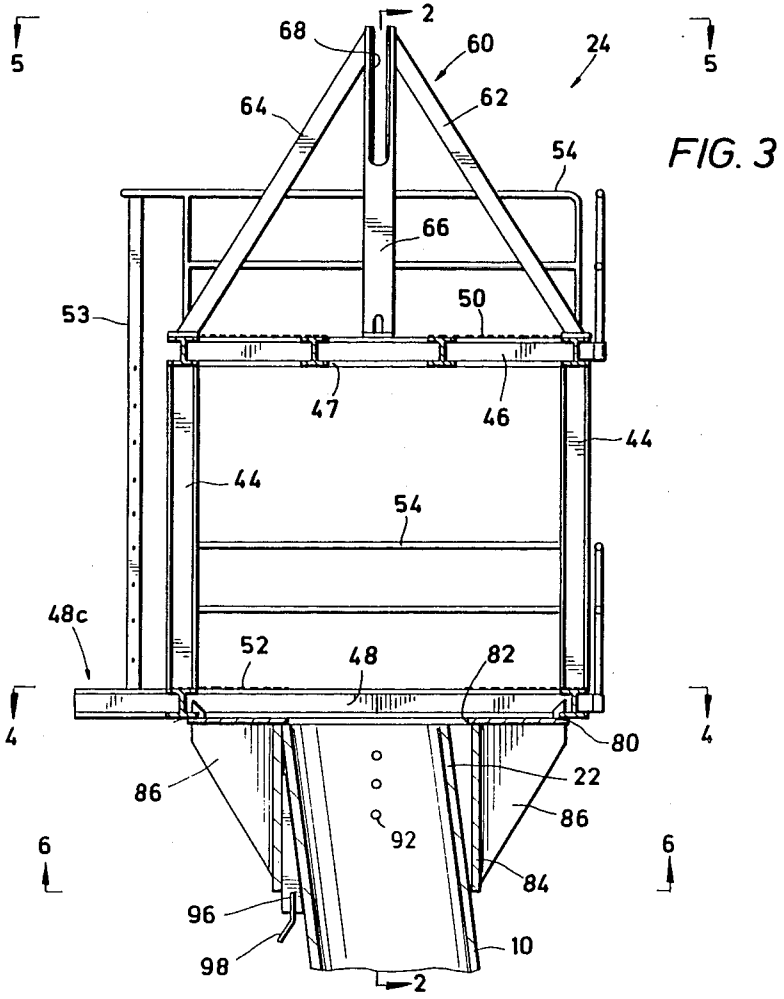
FIG. 3 is an elevational view, partly in section, showing the support means of the assembly of the present invention mounted on a piling which is at an angle to the vertical.

The piling 10 shown in FIG. 3 is angled relative to the vertical. As is well known, offshore platforms frequently have the legs or pilings at an angle to the vertical to provide structural stability. To accommodate the off vertical angle, a series of wedges 96 are disposed between the piling 10 and the interior of the guide 84, the wedges 96 serving to shim support 24 so as to maintain the platforms in a substantially horizontal disposition providing a generally horizontally disposed work surface. Each wedge 96 is provided with a cable 98 which can be used to remove the wedges 96 when the severing operation is completed. It will be understood that when installed, the wedges 96 are driven between the guide 84 and the piling 10 so as to securely hold the support 10 in the horizontal disposition.

Reference is now made to FIGS. 7–10 for a detailed description of the centralizer means 34 shown in FIG. 1. Centralizer 34 includes a tubular body portion 36 having a central bore 38 and upper and lower radially outwardly projecting flanges 40 and 42 respectively. Centralizer 34 further includes an upper cap assembly 45 having an opening **45*a* which registers with bore 38 and a flange 45*b* which mates with and is secured to flange 40 by means of circumferentially spaced bolts 49. Centralizer 34 also has a lower cap 51 having an opening 51*a* which registers with bore 38 and a flange 55 which mates with and is secured to flange 42 by means of circumferentially spaced bolts 57. Cap 45 provides a housing for upper thrust bearing assembly 70 supported by the bearing support member 72. Likewise, cap 51 provides a bearing housing for a lower thrust bearing assembly 74 supported by thrust bearing support 76. Suitable gaskets and seal rings are provided to seal off bearing assemblies 74 and 76** from the ingress of water, dirt, etc.

Secured to and projecting laterally outwardly from tubular body 36 are four circumferentially, equally spaced ribs 120, ribs 120 lying along the axis of body 38. Each of the ribs 120 has a series of axially spaced bores 122 in which is received a shaft 124, shaft 124 being retained in bore 122 by means of bolts 126 which are received in registering holes in rib 120 and shaft 124. Shaft 124 is secured to a U-shaped wheel frame 128, frame 128 having an end wall 130 with a threaded bore 132 into which is received the threaded outer end of shaft 124. A set screw 134 prevents shaft 124 from unthreading from bore 132. Frame 128 also includes spaced arms 136 and 138 in which are registering bores 140 and 142, respectively. An axle 144 is received in registering bores 140 and 142 and has one end 146 threaded to receive a nut 148 and thereby secure axle 144 in frame 128. Washers 150 and 152 are also provided as well as a grease fitting 154 which communicates with a port 156 to supply grease to the bearing assembly described hereafter. A wheel 158 is journaled on axle 144 by means of a wheel bearing assembly 160, grease being supplied to the bearing assembly 160 via port 156. Wheel retainers 162 and 164 support axle 144 and center bearing assembly 160 and wheel 158. Bearing seals **160*a* and 160*b* prevent the ingress of dirt and other contaminants into the bearing assembly 160**.

Secured to each of the ribs 120 at the end adjacent cap 45 is a plate 170, plate 170 being secured to rib 120 by means of bolts 172 and 174 received in registering bores in plate 170 and rib 120. Plate 170 provides a beveled surface 176. With particular reference to FIG. 7, there is shown a portion of piling 10 comprised of telescoped sections **10*a* and 10*b*. Offshore piling or conductor is commonly comprised of sections of pipe or uther tubular members which fit together by virtue of the fact that one end of each section, e.g. 10*b*, has a slight taper on it called a stabbing point such that it will fit into an adjoining section, e.g, 10*a*. In this way, the piling is built up to the desired height by stabbing the tapered nose of one section into the sightly larger end opening of the next section. The sections are then welded together and the process repeated. This results in the piling 10 having a series of annularly extending upsets 10*c* formed where the stabbed end of section 10*b* terminates internally of section 10*a*. The beveled surfaces 176 on plates 170 insure that when the cutting string 25 is pulled upwardly out of the piling 10, the centralizer 34 will not hang or catch on any of the internal upsets 10*c*. In other words, when the tapered surfaces 176 engage the upset 10*c*, the centralizer 34 will automatically be recentered in piling 10 allowing rollers 158 to smoothly traverse the upset 10*c***.

Rotatably journaled in bore 38 of body 36, bore **45*a* of cap 45 and bore 51*a* of cap 51 is a tubular shaft 180, shaft 180 being carried on bearing assemblies 70 and 74. Tubular shaft 180 is provided with pin and box connections 182 and 184, respectively, to enable centralizer 34 to be connected into pipe string 26. It will thus be seen that with centralizer 34 received in piling 10, body 36 of centralizer 34 will be permitted axial movement, i.e. along the length of pilng 10 but will undergo no substantial rotational movement as cutting string 25 and hence tubular shaft 180 are rotated. In other words, tubular shaft 180 is rotatable relative to body 36 of centralizer 34**.

The use of centralizer 34 in the severing assembly of the present invention permits piling which is set at an angle such as shown in FIG. 1 to be easily cut without the cutting string binding internally of the piling. Because the centralizer 34 maintains the cutting string essentially coaxial with the piling 10 throughout the cutting operation, neither the pipe string 26 nor the cutter 30, except for the cutter blades 32, engage the inside wall of the piling 10. The ability to sever angled piling is further enhanced in that the support or frame 24 can be shimmed, as described above, to an essentially horizontal disposition even though the piling 10 may be at a relatively severe angle to the vertical, e.g. 10 to 20 degrees.

While power swivel 27 has been shown as the source of rotational power for the cutting string 25, it is to be understood that any means by which the cutting string 25 can be rotated can be employed. The use of a power swivel which actually can be considered a portable piece of equipment is desirable because of the fact that the entire cutting assembly can then be relatively self-contained on the piling without the need to supply rotational power to the cutting string by means of a derrick barge, e.g. 11. Indeed, a unique feature of the method of the present invention is that the severing operation can be a fully contained operation on the offshore platform to be removed. Thus, portable power generators, diesel engines and the like needed to furnish power to the power swivel 27 can be supported on a remaining deck of the offshore platform to be removed and the severing assembly mounted on the piling 10 as shown. Thus, the piling can be severed without the necessity for a derrick barge in attendance.

The apparatus and method of the present invention provides a simple method whereby offshore tubular piling can be removed without the necessity for explosively severing the piling. Moreover, the unique construction of the apparatus of the present invention permits piling which is at an angle to the vertical, a situation which is typical with support piling or legs used on offshore platforms, to be removed. The method of the present invention is simple and does not require the use of deepsea divers. Once an open end of the tubular piling has been exposed, the cylindrical guide 84 need only be positioned to receive the upper end 22 of the piling 10. Once the support 24 has been secured to the piling 10 and relative rotation therewith prevented as by the use of the bolts 94, the cutting string comprised of the pipe string, the centralizer and the cutter can be lowered into the casing by successively attaching lengths of drill pipe or the like until the desired depth in the tubular piling is achieved. The upper end of the pipe string is then attached to the power swivel supported on the frame 24 and rotation commenced until the piling 10 is severed internally by the blades 32 on the cutter 28. The power swivel is then stopped and the blades 32 on the cutter 28 retracted. At this point, the pipe string can be removed by pulling the cutting string upwardly, sequentially removing successive sections of the pipe string until the complete pipe string has been recovered. The centralizer and cutters can then be removed and the entire assembly moved to the next piling. As noted above, the method can be carried out with the use of a derrick barge which can be used to retrieve the drill pipe sections, the centralizer and the cutter, remove the support and power swivel, etc. However, the method can also be carried out in a self-contained manner from the platform being removed by use of a portable crane or the like which can be used to effect lifting of the drill pipe sections, the centralizer, the cutter, the support, etc.

The centralizer 34 provides an innovative means whereby the cutting string 25 can be easily moved longitudinally through the pilng in either the up or down direction. Since the rollers 158 are mounted on axes which are generally transverse to the long axis of the centralizer, and since, in practice, the distance between opposed rollers 158 is such as to be slightly smaller than the approximate inside diameter of the piling 10, the cutting string 25 will be maintained centralized and generally coaxially aligned with piling 10. Thus, the centralizer 34 permits the cutter apparatus 28 to be lowered to the preselected position without the cutter apparatus 28 scraping against the inner wall of the piling 10. This is particularly desirable in cases where the piling is at an angle to the vertical. In such cases, the cutter apparatus would lay on the low side of the piling as the cutting string 25 was being inserted and removed from the piling 10. Moreover, during the actual cutting operation, there might be a tendency for the cutter blades 32 to sever the low side of the piling 10 first. However, with the use of the centralizer, the cutter apparatus 28 remains generally in the center of the piling 10 even during the cutting operation and even when the piling is at an angle to the vertical. While the centralizer is shown with four ribs, it is to be understood that three spaced ribs will suffice, provided the spacing of the ribs is such as to effect centering of the cutting string 25 in the piling 10. Thus, it is preferred that at least three equally spaced ribs be employed. The number of rollers affixed to each rib can vary depending upon the length of the cutting string, the diameter of the piling 10, etc. While the rollers have been shown as being affixed to ribs which project laterally outwardly from the body of the centralizer, it is to be understood that the rollers could be affixed directly to the body as, for example, by forming pockets or recesses in the tubular body and mounting the rollers in the pockets. As shown in the drawings, the centralizer is positioned in the cutting string 25 closely adjacent the cutter apparatus 28. This is to ensure that the cutter apparatus 25 remains coaxially aligned with the piling 10. It will be appreciated that additional centralizers can be included in the cutting string if desired. Thus, if the pipe string is of considerable length, it may be desirable to place one or more additional centralizers upwardly in the cutting string.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. An assembly for severing offshore tubular piling comprising:

a support means for securing to a tubular piling adjacent the upper, open end thereof such that said open end is substantially unobstructed;

guide means carried by said support means for positioning around said upper end of said piling;

a pipe string suspended from said support means for extending into said tubular piling;

a centralizer means secured in said pipe string for positioning in said tubular piling, said centralizer means having a body, said pipe string being rotatable relative to said body of said centralizer means;

a cutter apparatus secured in said pipe string at the lower end thereof, said cutter apparatus including means for severing said tubular piling in response to rotational movement of said pipe string; and means to rotate said pipe string.

2. The assembly of claim 1 wherein said centralizer means includes an elongate body having a bore therethrough and a long axis extending generally along an axis passing through the length of said pipe string, a shaft rotatably mounted in said bore for rotation relative to said body, at least three roller assemblies secured to said body and generally equally spaced around the periphery thereof, each of said roller assemblies having a roller member extending laterally outwardly from said body, each of said roller members being rotatable about an axis transverse to the long axis of said body.

3. The assembly of claim 1 wherein said means to rotate said pipe string comprises a power swivel secured to said support means.

4. The assembly of claim 1 wherein said guide means includes a cylindrical guide tube carried by said support means for receiving the upper end of said piling.

5. The assembly of claim 1 including means to prevent relative rotation between said support and said piling.

6. A method for removing offshore tubular piling comprising:

attaching a support means to a tubular piling adjacent the top, open end of said tubular piling;

providing a guide means for positioning around said upper end of said piling;

suspending a cutting string from said support means and into said tubular piling, said cutting string including a pipe string, a centralizer means secured in said pipe string, said centralizer means having a body, said pipe string being rotatable relative to said body of said centralizer means and a cutter apparatus secured in said pipe string at the lower end thereof, said cutter apparatus including means for internally severing said tubular piling in response to rotational movement of said pipe string;

positioning said cutting string such that said centralizer and said cutter apparatus are disposed at a desired location in said tubular piling;

rotating said pipe string to effect internal severing of said tubular piling; and removing said severed piling.

7. The method of claim 6 wherein said piling is at an angle to the vertical and including the step of shimming said support means to provide a generally horizontally disposed work surface.

* * * * *